US008517232B1

(12) United States Patent
Geltzer et al.

(10) Patent No.: US 8,517,232 B1
(45) Date of Patent: Aug. 27, 2013

(54) COLLAPSIBLE GARMENT HANGER

(75) Inventors: Mark Stuart Geltzer, Miami, FL (US); Caesar Earle Ciaglia, Mokena, IL (US)

(73) Assignee: Swissrael, LLC, New Lenox, IL (US)

( * ) Notice: Subject to any disclaimer, the term of this patent is extended or adjusted under 35 U.S.C. 154(b) by 43 days.

(21) Appl. No.: 13/271,770

(22) Filed: Oct. 12, 2011

Related U.S. Application Data

(60) Provisional application No. 61/455,173, filed on Oct. 15, 2010.

(51) Int. Cl.
*A41D 27/22* (2006.01)

(52) U.S. Cl.
USPC ..... 223/94; 223/92

(58) Field of Classification Search
USPC ..... 223/85, 89, 90, 94, 92
See application file for complete search history.

(56) References Cited

U.S. PATENT DOCUMENTS

| | | | | |
|---|---|---|---|---|
| 2,440,637 | A * | 4/1948 | Lowe | 223/94 |
| 2,699,276 | A * | 1/1955 | Goodman | 223/94 |
| 2,745,579 | A * | 5/1956 | Goodman | 223/94 |
| 2,926,823 | A * | 3/1960 | Weiser | 223/94 |
| 3,151,788 | A * | 10/1964 | Wingate | 223/94 |
| 3,698,043 | A * | 10/1972 | Batts | 223/87 |
| 4,524,890 | A * | 6/1985 | Fulton | 223/94 |
| 5,397,038 | A * | 3/1995 | Hunt | 223/89 |
| 5,690,257 | A * | 11/1997 | Ward | 223/94 |
| 2007/0075103 | A1* | 4/2007 | Stubbers | 223/85 |
| 2011/0233240 | A1* | 9/2011 | Morawietz | 223/94 |

* cited by examiner

*Primary Examiner* — Nathan Durham
(74) *Attorney, Agent, or Firm* — Albert Bordas, P.A.

(57) ABSTRACT

A collapsible garment hanger having a male arm with an integral hinge mechanism mounted onto a partial disc, and a female arm having a hanger hook. The female arm and the male arm are joined at the integral hinge mechanism. The female arm comprises lateral walls to define a channel. The channel is shaped to cooperatively receive the partial disc. The female arm comprises female parts to receive the integral hinge mechanism. The channel receives the partial disk when the male arm and the female arm are in an extended position. The male arm further has an integral connection and a latch. The latch has a first set of teeth, and the female arm further has a second set of teeth. The first set of teeth engages the second set of teeth when the male arm and the female arm are in an extended position.

18 Claims, 5 Drawing Sheets

COLLAPSIBLE GARMENT HANGER

BACKGROUND OF THE INVENTION

1. Field of the Invention

The present invention relates to a collapsible garment hanger and more particularly, to a hanger for "pullover" garments such as T-shirts, polo style shirts, golf and tennis shirts, turtlenecks, sweatshirts, some sweaters and other garments.

2. Other Related Applications.

The present non-provisional patent application claims the benefit under 35 U.S.C. 119(e) of Provisional Application No. 61/455,173, filed on Oct. 15, 2010, which is hereby incorporated by reference.

3. Description of the Related Art.

There exist many garment hangers performing the function of hanging an article of clothing. Frequently, when hanging "pullover" garments such as T-shirts, polo style shirts, golf and tennis shirts, turtlenecks, sweatshirts, some sweaters and other garments, conventional hangers do not work well and may stretch, deform and possibly damage the garment. To avoid such problems would require the user to insert and feed the hanger up through the bottom of the garment, an awkward and time-consuming procedure.

A variety of "collapsible" hangers designed to solve the problems associated with conventional "non-collapsible" hangers have been proposed in which the two hanger arms are movable between an extended position and a collapsed position. While they may facilitate the process of hanging garments in theory, they are often complex in design, construction and not easily used by the consumer. Many are not durable and have multiple flimsy hinges, and many are not possible to manufacture in a cost effective manner. Additionally, none of the prior art embodiments provides for simple removal of the garment from the hanger, with one hand and without removing the hanger from the closet rod or hanger rack. All existing embodiments require two hands to remove the garment from the hanger, one hand to hold the garment and one hand to operate the hanger and many necessitate the removal of the hanger from the closet rod or hanger rack.

Thus, while complicated and uncomplicated collapsible hangers have been proposed, none have succeeded in providing a simple, durable, user friendly hanger that can be commercially manufactured in a cost effective manner. These disadvantages of the prior art are overcome by the present invention.

SUMMARY OF THE INVENTION

The present invention, briefly described, provides a collapsible hanger to be used in the hanging and un-hanging of garments. The hanger, of injection molded plastic construction in a preferred embodiment, incorporates a pair of opposed, pivoting, garment supporting arms that can be extended to hang a garment, or collapsed to remove a garment from the hanger. The two arms are articulated by means of an integral pivoting hinge located on the inferior border at the center of the hanger. An integral latch mechanism is incorporated along a portion of the superior border of the hanger's arms, subjacent and adjacent to the integral suspending rod hook. Activation of this latch with the use of one finger, preferably the thumb or forefinger, disengages the latch and collapses the hanger from the extended position allowing for the simple one handed removal of a garment from the hanger without removing the hanger from the closet rod or hanger rack. This latch engages automatically when hanging a garment upon extension of the hanger arms to the extended position(s). To provide stability, a region of interposition of the two hanger arms is incorporated in the design. This region, around and near the center of rotation of the hanger, combined with the large diameter of the integral pivoting hinge mechanism produces a durable and dependable structure.

It is therefore one of the main objects of the present invention to provide a collapsible garment hanger that is easy to make and use.

It is another object of this invention to provide a collapsible garment hanger that facilitates the processes of hanging and/or removing a garment thereto/from.

It is another object of this invention to provide a collapsible garment hanger for hanging "pullover" garments such as T-shirts, polo style shirts, golf and tennis shirts, turtlenecks, sweatshirts, some sweaters and other garments, without stretching, deforming, or damaging the garment.

It is another object of this invention to provide a collapsible garment hanger that minimizes time-consuming procedures such as inserting and feeding the hanger up through the bottom of the garment.

It is another object of this invention to provide a collapsible garment hanger, which provides for simple removal of the garment from the hanger.

It is another object of this invention to provide a collapsible garment hanger that permits the removing of the garment with one hand and without removing the hanger from the closet rod or hanger rack.

It is another object of this invention to provide a collapsible garment hanger that is volumetrically efficient for carrying, transporting and storage.

It is another object of this invention to provide a collapsible garment hanger that can be readily assembled without the need of any special tools.

It is another object of this invention to provide a collapsible garment hanger, which is of a durable and reliable construction. It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
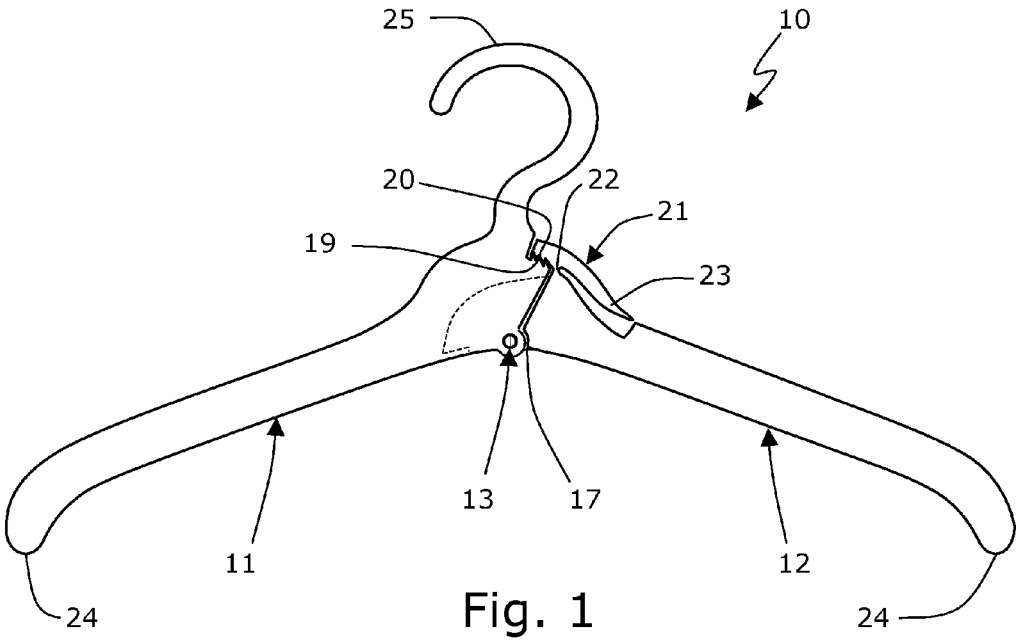
FIG. 1 is an elevational view of the instant invention in an extended position.

Referring now to the drawings, the present invention is a collapsible garment hanger and is generally referred to with numeral 10. It can be observed that it basically includes male arm 12 having integral hinge mechanism 13, and female arm 11.

Figure 2:
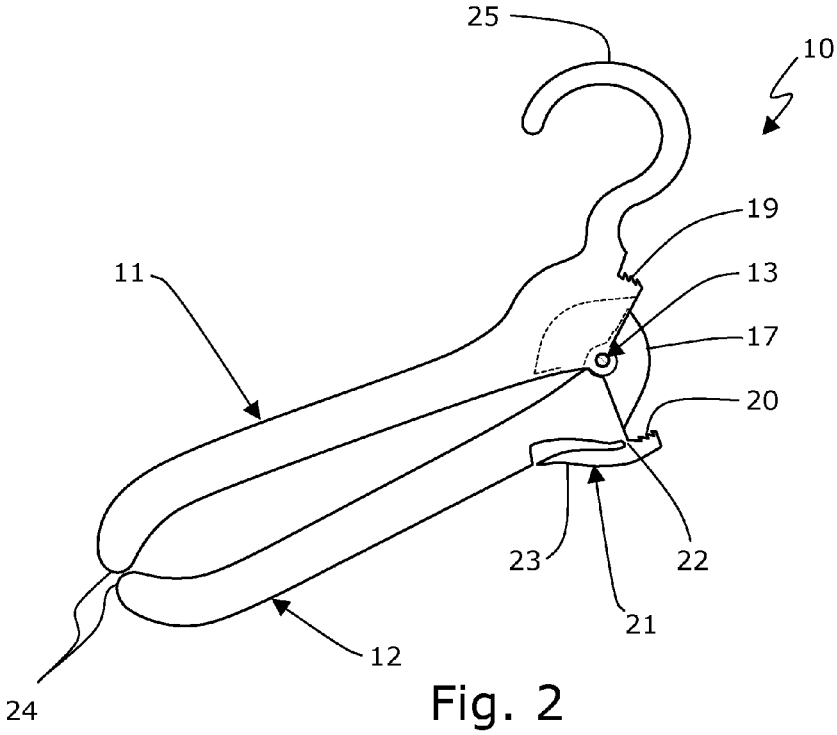
FIG. 2 is an elevational view of the instant invention in a collapsed position.
Figure 3:
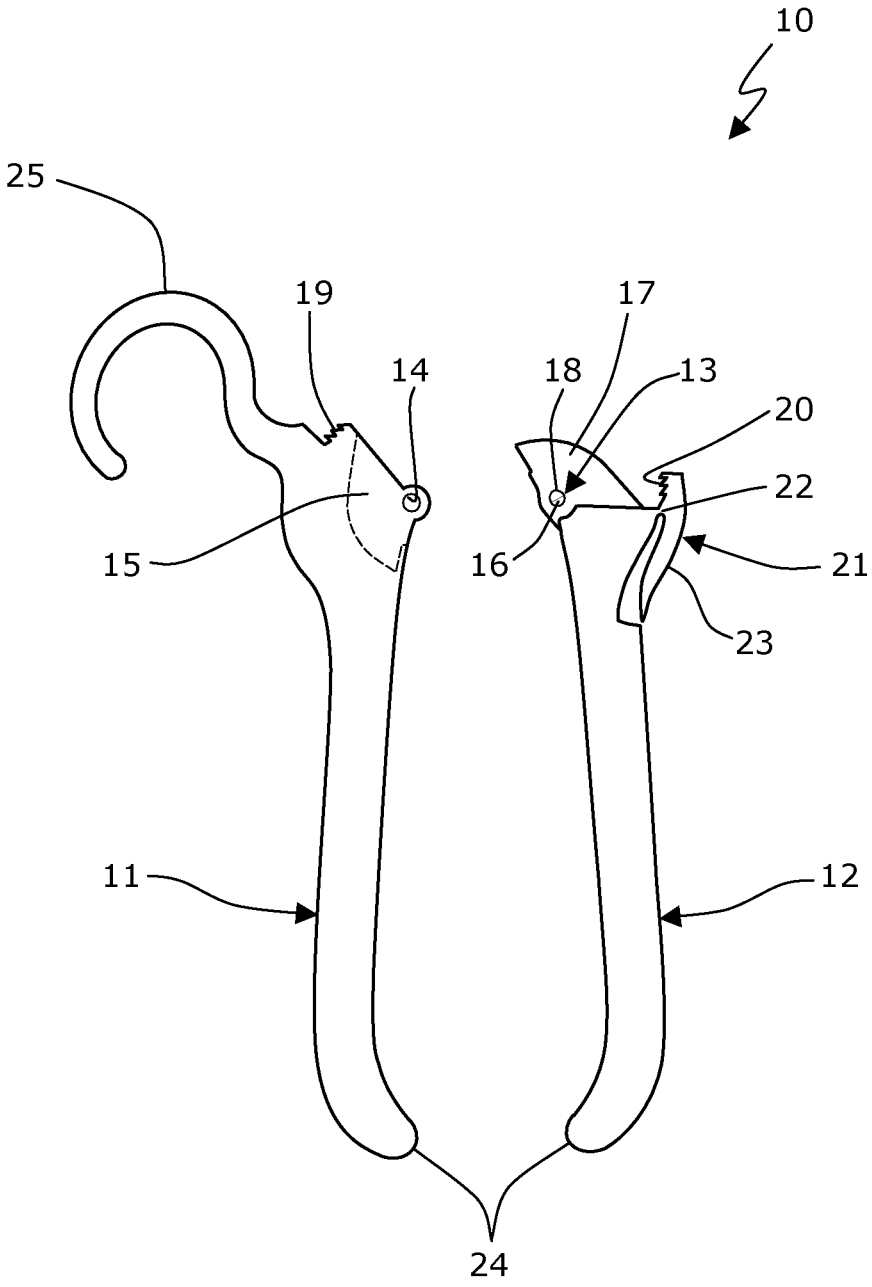
FIG. 3 is an elevational view of the instant invention disassembled.

As seen in FIGS. 1, 2, and 3, collapsible garment hanger 10 comprises male arm 12 having integral hinge mechanism 13, and female arm 11. Female arm 11 and male arm 12 joined at integral hinge mechanism 13. Female arm 11 and male arm 12 can be articulated between a fully extended position, as illustrated in FIG. 1, and a collapsed position as illustrated in FIG. 2. The articulation is provided by integral hinge mechanism 13. Female arm 11 comprises hanger hook 25. Male arm 12 comprises latch 21 and partial disc 17.

As seen in FIG. 2, collapsible garment hanger 10 is designed so that female arm 11 and male arm 12 will cease to collapse when free ends 24 approximate.

As seen in FIG. 3, female parts 14 of integral hinge mechanism 13 are integral to opposed female arm 11, and male parts 16 and partial disc 17 are integral to male arm 12, extending from a portion of its proximal and approximating surface. Latching means are provided by two sets of teeth 19 and 20. Set of teeth 19 is integral to female arm 11, and set of teeth 20 is located on latch 21, which is an integral part of male arm 12. The mechanical and physical characteristics of integral connection 22, along with flexible and resilient qualities of a plastic polymer or polymers used, ensure that set of teeth 20 of latch 21 on male arm 12 will forcefully engage set of teeth 19 of female arm 11 upon extension of female arm 11 and male arm 12, and readily collapse when applying finger pressure to area 23 of latch 21. Furthermore, the inclination and angulations of sets of teeth 19 and 20, relative to an arc of curvature (closure) of integral hinge mechanism 13, results in set of teeth 19 and set of teeth 20 closing or "biting" with greater force as garment 28 weight increases.

Collapsible garment hanger 10 will support garments 28 of any weight including the heaviest jackets and coats. While collapsible garment hanger 10 described and illustrated in the drawings has sets of teeth 19 and 20, one set on female arm 11 and male arm 12 respectively, it is possible to use fewer teeth in each set or to incorporate more teeth and/or teeth spaced farther apart. Adding additional teeth and/or spacing the teeth farther apart would require minor modifications in the design but would provide collapsible garment hanger 10 as previously described with the additional and novel feature of having multiple final extended hanging positions. There is great variation in hanger form and design and in the angles formed by female arm 11 and male arm 12. These angles range from approximately 25 degrees to approximately 60 degrees.

Hanger hook 25 is an integral part of female arm 11. A non-integral and swiveling hook model is contemplated as well as a "hook-less" or "hotel style" model for public use. Although they are not part of this original embodiment, anti-slip features located on the superior surface of female arm 11 and male arm 12 are contemplated. These anti-slip features may be integral to female arm 11 and male arm 12 and textural in nature, or be made of a different material.

In an alternate embodiment, instant invention 10 comprises receptacles for strapped garments and the like. These features or ones functionally equivalent may be incorporated into the upper and/or lower surfaces of female arm 11 and male arm 12.

Figure 4:
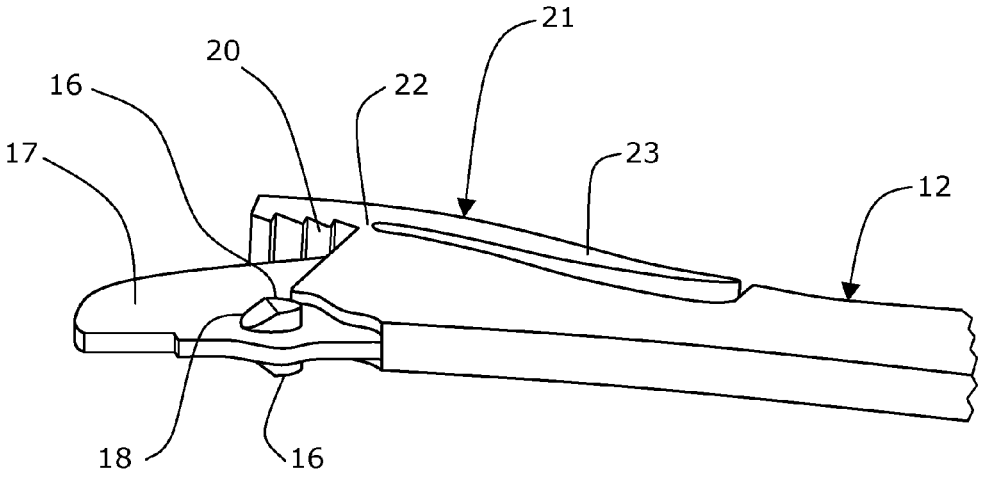
FIG. 4 is an isometric close up view of opposed arm 12 disassembled from opposed arm 11.

As seen in FIG. 4, male parts 16 of integral hinge mechanism 13 located on both sides of the male arm 12 have ramped portion 18 to facilitate assembly and to prevent disassembly of female arm 11 and male arm 12.

Figure 5:
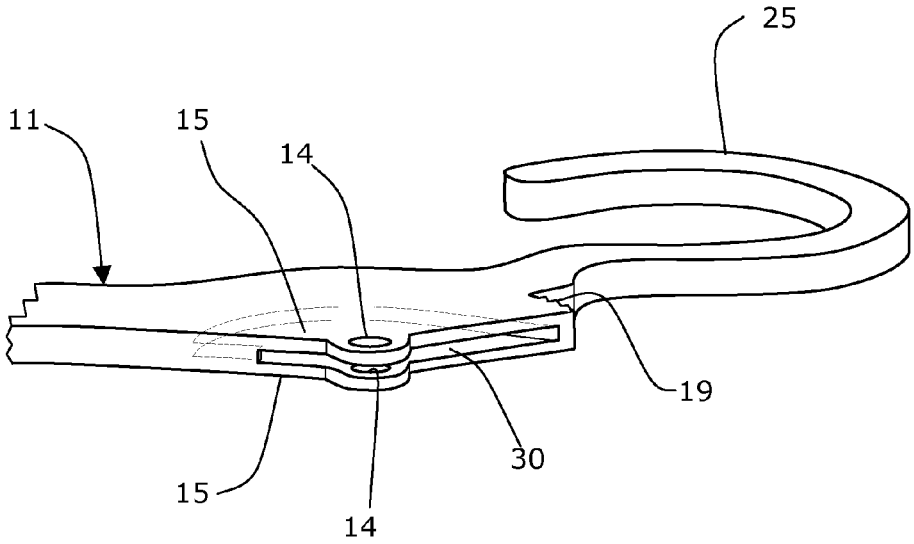
FIG. 5 is an isometric close up view of opposed arm 11 disassembled from opposed arm 12.

As seen in FIG. 5, female parts 14 at an inferior extreme of a proximal border of female arm 11 are cooperatively shaped to receive male parts 16, ramped portion 18 first. Once male parts 16 fully enter female parts 14, thus assembling collapsible garment hanger 10 from its two component parts, female arm 11 and male arm 12 cannot be disassembled. This is principally due to the shape and direction of ramped portion 18 on male parts 16 of male arm 12. As illustrated in FIG. 2, partial disc 17 is interposed within channel 30 formed by a space between lateral walls 15 of female arm 11 where partial disc 17 of male arm 12 is received. This feature gives collapsible garment hanger 10 exceptional stability and durability.

Figure 6A:
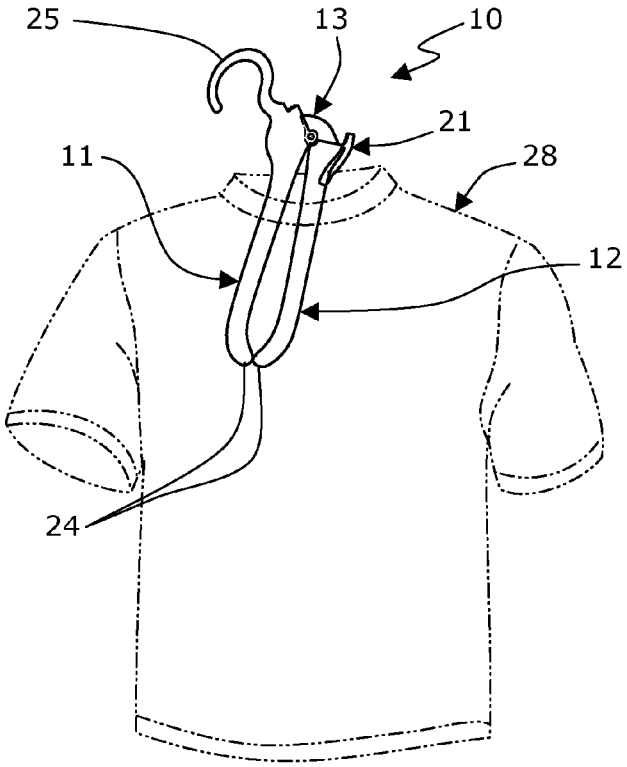
FIG. 6A is an isometric view of the instant invention in the collapsed position being introduced into a neck of a t-shirt.
Figure 6B:
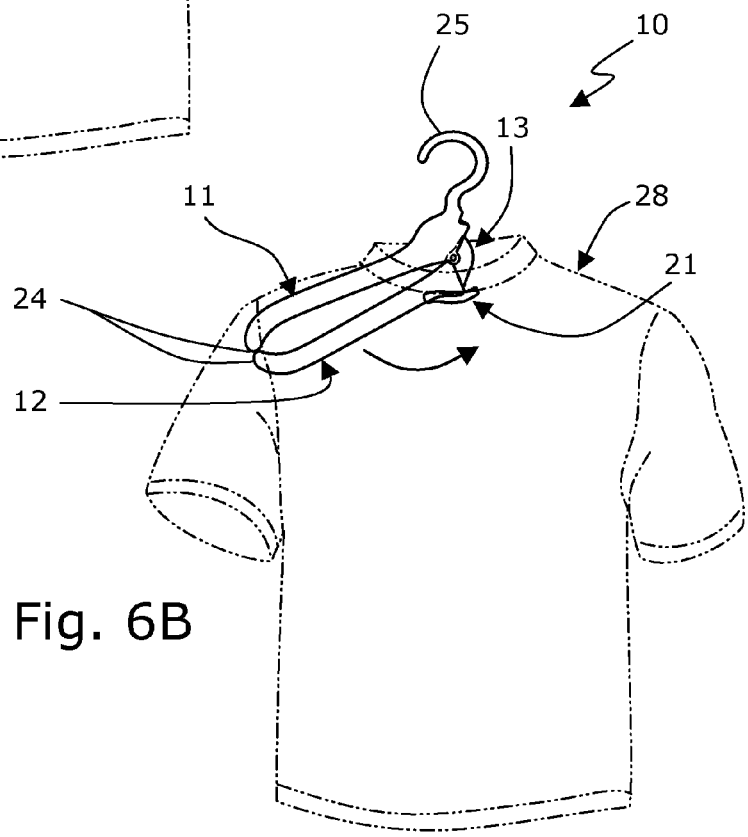
FIG. 6B is an isometric view of the instant invention in the collapsed position fully introduced into the neck of the t-shirt.
Figure 6C:
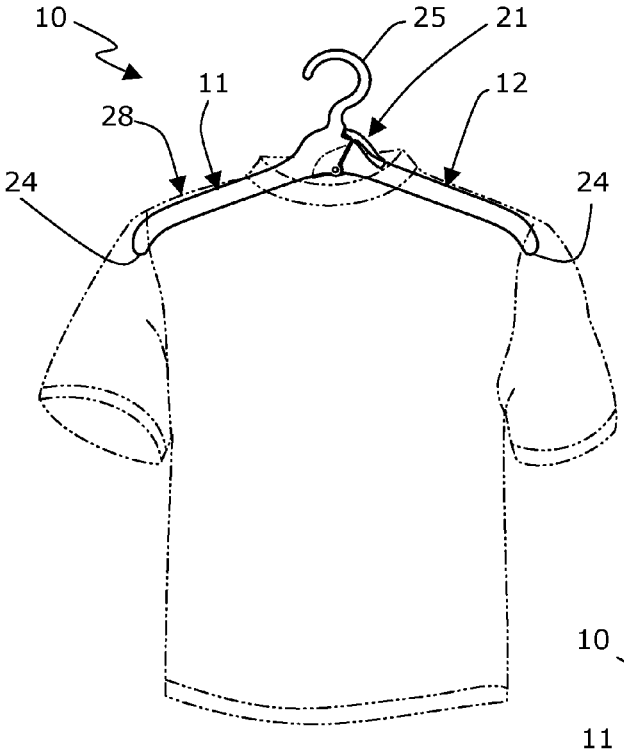
FIG. 6C is an isometric view of the instant invention in the extended position within the neck of the t-shirt.

As seen in FIGS. 6A, 6B, and 6C to hang garment 28, free ends 24 are inserted through the neck opening of garment 28 and female arm 11 and male arm 12 are rotated upwardly and extended in opposite direction to the latched position.

Figure 6D:
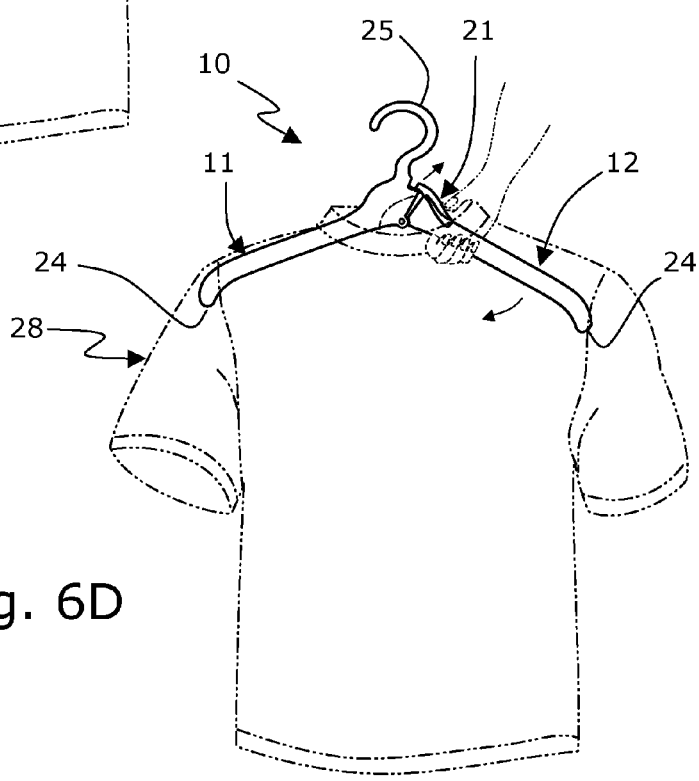
FIG. 6D is an isometric view of the instant invention being collapsed to remove a garment therefrom.

As seen in FIG. 6D, a user gently supports garment 28 while pressing area 23 of latch 21 and collapsible garment hanger 10 instantly collapses downward leaving the user with garment 28 in hand.

For the purpose of lowering the cost of production and provide a more economical product for a consumer, a three-piece design including female arm 11 and male arm 12 joined at integral hinge mechanism 13 may be used.

The foregoing description conveys the best understanding of the objectives and advantages of the present invention. Different embodiments may be made of the inventive concept of this invention. It is to be understood that all matter disclosed herein is to be interpreted merely as illustrative and not in a limiting sense.

What is claimed is:

1. A collapsible garment hanger, comprising:

A) a male arm having an integral hinge mechanism, an integral connection, and a latch, said integral connection is located between opposing distal ends of said latch thus defining latching means on a first side of said integral connection and a pressing area on a second side of said integral connection, said integral hinge mechanism defining an integral pivoting hinge; and B) a female arm, said female arm and said male arm joined at said integral hinge mechanism, said male and female arms are articulated by means of said integral pivoting hinge located on an inferior border at a lengthwise center of said hanger, said male and female arms part at an angle other than 90 degrees, said male and female arms collapse at said lengthwise center of said hanger, said female arm further comprises a channel, and said male arm comprises a partial disc, said channel receives said partial disk when said male arm and said female arm are in an extended position, said partial disk extends beyond said latch at said lengthwise center of said hanger when in said extended position.

2. The collapsible garment hanger set forth in claim 1, further characterized in that said female arm comprises a hanger hook.

3. The collapsible garment hanger set forth in claim 1, further characterized in that said female arm comprises lateral walls to define said channel.

4. The collapsible garment hanger set forth in claim 3, further characterized in that said channel is shaped to cooperatively receive said partial disc.

5. The collapsible garment hanger set forth in claim 4, further characterized in that said integral hinge mechanism is mounted onto said partial disc.

6. The collapsible garment hanger set forth in claim 5, further characterized in that said integral hinge mechanism is mounted onto each side of said partial disc.

7. The collapsible garment hanger set forth in claim 1, further characterized in that said female arm comprises female parts to receive said integral hinge mechanism.

8. The collapsible garment hanger set forth in claim 1, further characterized in that said latch comprises a set of teeth.

9. The collapsible garment hanger set forth in claim 1, further characterized in that said female arm further comprises a set of teeth.

10. The collapsible garment hanger set forth in claim 1, further characterized in that said latch comprises a first set of teeth, and said female arm further comprises a second set of teeth, said first set of teeth engages said second set of teeth when said male arm and said female arm are in said extended position.

11. The collapsible garment hanger set forth in claim 10, further characterized in that said integral hinge mechanism comprises a male part and a ramped portion, said ramped portion extending from said partial disk to said male part.

12. A collapsible garment hanger, comprising:

A) a male arm having an integral hinge mechanism, an integral connection, and a latch, said integral connection is located between opposing distal ends of said latch thus defining latching means on a first side of said integral connection and a pressing area on a second side of said integral connection, said integral hinge mechanism mounted onto a partial disc, said integral hinge mechanism defining an integral pivoting hinge; and B) a female arm having a hanger hook, said female arm and said male arm joined at said integral hinge mechanism, said male and female arms are articulated by means of said integral pivoting hinge located on an inferior border at a lengthwise center of said hanger, said male and female arms collapse at said lengthwise center of said hanger, said female arm further comprises a channel, and said male arm comprises said partial disc, said channel receives said partial disk when said male arm and said female arm are in an extended position, said partial disk extends beyond said latch at said lengthwise center of said hanger when in said extended position.

13. The collapsible garment hanger set forth in claim 12, further characterized in that said female arm comprises lateral walls to define said channel, said channel is shaped to cooperatively receive said partial disc.

14. The collapsible garment hanger set forth in claim 13, further characterized in that said female arm comprises female parts having a completely enclosed hole to receive a ramped portion of said integral hinge mechanism.

15. The collapsible garment hanger set forth in claim 14, further characterized in that said channel receives said partial disk when said male arm and said female arm are in said extended position.

16. The collapsible garment hanger set forth in claim 15, further characterized in that said latch comprises a first set of teeth, and said female arm further comprises a second set of teeth, said first set of teeth engages said second set of teeth when said male arm and said female arm are in said extended position.

17. The collapsible garment hanger set forth in claim 16, further characterized in that said integral hinge mechanism comprises a male part and a ramped portion, said ramped portion extending from said partial disk to said male part.

18. A collapsible garment hanger, comprising:

A) a male arm having an integral hinge mechanism, an integral connection, and a latch, said integral connection is located between opposing distal ends of said latch thus defining latching means on a first side of said integral connection and a pressing area on a second side of said integral connection, said integral hinge mechanism defining an integral pivoting hinge; and B) a female arm, said female arm and said male arm joined at said integral hinge mechanism, said male and female arms are articulated by means of said integral pivoting hinge located on an inferior border at a lengthwise center of said hanger, said male and female arms part at an angle other than 90 degrees, said male and female arms collapse at said lengthwise center of said hanger, said female arm further comprises a channel, and said male arm comprises a partial disc, said channel receives said partial disk when said male arm and said female arm are in an extended position, said partial disk extends beyond said latch at said lengthwise center of said hanger when in said extended position, said female arm comprises a hanger hook, said female arm comprises lateral walls to define said channel, said channel is shaped to cooperatively receive said partial disc, said integral hinge mechanism is mounted onto each side of said partial disc, said female arm comprises female parts to receive said integral hinge mechanism, said latch comprises a first set of teeth, and said female arm further comprises a second set of teeth, said first set of teeth engages said second set of teeth when said male arm and said female arm are in said extended position, said integral hinge mechanism comprises a male part and a ramped portion, said ramped portion extending from said partial disk to said male part.

* * * * *